US011428468B2

(12) United States Patent
Uemura et al.

(10) Patent No.: US 11,428,468 B2
(45) Date of Patent: Aug. 30, 2022

(54) ROTARY HEARTH FURNACE, AND METHOD FOR PRODUCING REDUCED IRON USING ROTARY HEARTH FURNACE

(71) Applicant: Kobe Steel, Ltd., Kobe (JP)

(72) Inventors: Tomoki Uemura, Kobe (JP); Sumito Hashimoto, Kobe (JP); Koji Tokuda, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 712 days.

(21) Appl. No.: 16/315,916

(22) PCT Filed: Jun. 28, 2017

(86) PCT No.: PCT/JP2017/023709
§ 371 (c)(1),
(2) Date: Jan. 7, 2019

(87) PCT Pub. No.: WO2018/012287
PCT Pub. Date: Jan. 18, 2018

(65) Prior Publication Data

US 2019/0301800 A1 Oct. 3, 2019

(30) Foreign Application Priority Data

Jul. 15, 2016 (JP) ..... JP2016-140166

(51) Int. Cl.
*F27B 9/16* (2006.01)
*C21B 13/10* (2006.01)
*F27B 9/34* (2006.01)

(52) U.S. Cl.
CPC ..... *F27B 9/16* (2013.01); *C21B 13/10* (2013.01); *C21B 13/105* (2013.01); *F27B 9/34* (2013.01)

(58) Field of Classification Search
CPC ..... C21B 13/10; C21B 13/105; F27B 9/16; F27B 9/34
(Continued)

(56) References Cited

U.S. PATENT DOCUMENTS 6,413,471 B1 * 7/2002 Kamikawa ..... C21B 13/105 266/177
8,012,236 B2 * 9/2011 Tokuda ..... C21B 13/105 75/484
(Continued)

OTHER PUBLICATIONS

International Search Report dated Jul. 25, 2017 in PCT/JP2017/023709 filed on Jun. 28, 2017.

*Primary Examiner* — Scott R Kastler
*Assistant Examiner* — Michael Aboagye
(74) *Attorney, Agent, or Firm* — Oblon, McClelland, Maier & Neustadt, L.L.P.

(57) ABSTRACT

A rotary hearth furnace includes: a furnace body which surrounds a ring-like space; a hearth portion which forms a bottom portion of the ring-like space and is rotatable in the rotational direction; a gas exhaust portion which discharges an exhaust gas generated in the ring-like space to the outside of the furnace body; an introducing portion; and a flow rate regulating portion. The introducing portion is disposed upstream of the gas exhaust portion in the rotational direction and introduces a pressure regulating gas into a non-heating section of the ring-like space. The flow rate regulating portion is disposed between the introducing portion and the gas exhaust portion and regulates a flow rate of a gas by adjusting an opening area of the non-heating section.

19 Claims, 2 Drawing Sheets

(58) Field of Classification Search
USPC ..... 266/173, 177; 75/474, 477; 432/138, 432/27; 110/275, 247, 246, 226
See application file for complete search history.

(56) References Cited

U.S. PATENT DOCUMENTS

| | | | | |
|---|---|---|---|---|
| 10,294,535 | B2 * | 5/2019 | Yaso | F27B 3/16 |
| 2002/0027317 | A1 * | 3/2002 | Imaizumi | C21B 13/10 266/168 |
| 2010/0031776 | A1 * | 2/2010 | Englund | F27B 9/30 75/392 |
| 2015/0203931 | A1 * | 7/2015 | Sugiyama | C21B 11/08 75/10.67 |
| 2017/0198365 | A1 | 7/2017 | Yaso | |

* cited by examiner

ROTARY HEARTH FURNACE, AND METHOD FOR PRODUCING REDUCED IRON USING ROTARY HEARTH FURNACE

TECHNICAL FIELD

The present invention relates to a rotary hearth furnace and a method for producing reduced iron using the rotary hearth furnace.

BACKGROUND ART

Conventionally, as a method for producing reduced iron by reducing agglomerates containing iron oxide, there has been known a method using a rotary hearth furnace. The rotary hearth furnace described in Patent Literature 1 includes: a ring-like furnace body; and a ring-like hearth rotated horizontally in a predetermined rotational direction. A ring-like space is formed by the ring-like furnace body and the ring-like hearth. The ring-like space has: a heating section where agglomerates in the furnace are heated by a heating burner; and a non-heating section where the agglomerates are not heated. The agglomerates placed on the hearth pass through the heating section along with the rotation of the hearth, and are subjected to reduction treatment by being heated during a period that the agglomerates pass through the heating section. As a result, reduced iron is produced.

A gas generated in the ring-like space during an operation of the above-mentioned rotary hearth furnace is discharged by an exhaust unit to the outside of the furnace as an exhaust gas. As the flow of the gas in the ring-like space, there are flows which flow in directions opposite to each other, that is, a forward direction gas flow which flows in a rotational direction of the hearth, and a reverse direction gas flow which flows in a direction opposite to the rotational direction. Both flows are directed toward the exhaust unit.

In the method described above, in a state where the exhaust gas forms the reverse direction gas flow over the entire length of the heating section (that is, forming a complete counterflow), heat exchange efficiency between an exhaust gas and agglomerates on the hearth becomes maximum and hence, heat of an exhaust gas can be effectively used for producing reduced iron. To obtain such a complete counterflow in the heating section, it is necessary to regulate a pressure in the ring-like space such that a diverging point of the above-mentioned gas flows in two directions is positioned at a boundary between the heating section and the non-heating section at a downstream end of the heating section in the rotational direction.

In view of the above, in the rotary hearth furnace described in Patent Literature 1 above, to obtain the above-mentioned complete counterflow in the heating section, the above-mentioned exhaust unit is disposed in the non-heating section. Further, in the non-heating section, an outside air intake unit which takes outside air into the ring-like space is disposed at a position upstream of the exhaust unit in the rotational direction. The outside air intake unit is provided for the purpose of increasing a pressure loss for establishing a pressure balance between the heating section and the non-heating section, and increases a pressure in the non-heating section by taking outside air into the non-heating section. Accordingly, the regulation of a pressure in the ring-like space is performed where the position of the diverging point of flows of the above-mentioned exhaust gas in two directions is disposed close to the boundary between the heating section and the non-heating section described above.

However, in the above-mentioned rotary hearth furnace, the position of the diverging point of the flows of the exhaust gas is adjusted only by increasing a pressure in the non-heating section by air taken into the inside of the furnace by the outside air intake unit in most cases. Accordingly, when an amount of an exhaust gas largely changes due to a burning state of a heating burner in the heating space, it is necessary to largely change an amount of air taken into the inside of the furnace by the outside air intake unit corresponding to such a change in an amount of the exhaust gas. As a result, it is difficult to adjust the position of the above-mentioned diverging point to the position in the vicinity of the boundary between the heating section and the non-heating section while suppressing an amount of air taken into the inside of the furnace.

Particularly, the above-mentioned intake of excessive air brings about a heat loss due to excessive cooling of the hearth in the non-heating section.

CITATION LIST

Patent Literature

Patent Literature 1: JP-A-2016-23319

SUMMARY OF INVENTION

It is an object of the present invention to provide a rotary hearth furnace capable of adjusting the position of a diverging point of an exhaust gas to a position in the vicinity of a boundary between a heating section and a non-heating section while suppressing an amount of a gas taken into the inside of the furnace, and a method for producing reduced iron using the rotary hearth furnace.

There is provided a rotary hearth furnace for producing reduced iron by reducing iron oxide by heating agglomerates containing iron oxide, the rotary hearth furnace including: a furnace body which has a pair of peripheral walls and a ceiling plate that enclose a ring-like space having a continuous ring-like shape at lateral sides and an upper side of the ring-like space, respectively; a ring-like hearth portion which forms a bottom portion of the ring-like space and which is rotatable in a predetermined rotational direction; a gas exhaust portion for discharging an exhaust gas generated in the ring-like space to the outside of the furnace body; an introducing portion; and a flow rate regulating portion. The ring-like space has a heating zone where the agglomerates placed on the hearth portion are heated and a non-heating zone where the agglomerates are not heated. The heating zone and the non-heating zone are joined with each other in a ring-like shape to thereby form the ring-like space. The gas exhaust portion is disposed in the non-heating zone. The introducing portion is disposed upstream of the gas exhaust portion in the rotational direction in the non-heating zone, and introduces a pressure regulating gas for regulating a pressure in the ring-like space into the non-heating zone. The flow rate regulating portion is disposed between the introducing portion and the gas exhaust portion in the non-heating zone, and regulates a flow rate of a gas which flows through the non-heating zone by adjusting an opening area of the non-heating zone.

Further, there is provided a method for producing reduced iron by reducing iron oxide by heating agglomerates containing the iron oxide using a rotary hearth furnace which includes: a furnace body having a pair of peripheral walls and a ceiling plate that enclose a ring-like space having a continuous ring-like shape at lateral sides and an upper side of the ring-like space, respectively; and a ring-like hearth portion which forms a bottom portion of the ring-like space and is rotatable in a predetermined rotational direction.

The method includes: a heating operation of producing reduced iron by reducing iron oxide contained in agglomerates by heating the agglomerates placed on the hearth portion in a heating zone which forms a section being a portion of the ring-like space; a gas discharging operation of discharging an exhaust gas generated in the ring-like space to the outside of the ring-like space in a non-heating zone connected to the heating zone in the ring-like space; an introducing operation of introducing a pressure regulating gas to a position upstream of a position where the exhaust gas is discharged in the non-heating zone in the rotational direction; and a flow rate regulating operation of regulating a flow rate of a gas which flows between a discharge position at which the exhaust gas is discharged in the non-heating zone and an introducing position at which the pressure regulating gas is introduced by adjusting an opening area of the non-heating zone.

DESCRIPTION OF EMBODIMENTS

Hereinafter, an embodiment of the present invention is described in further detail with reference to drawings.

Figure 1:
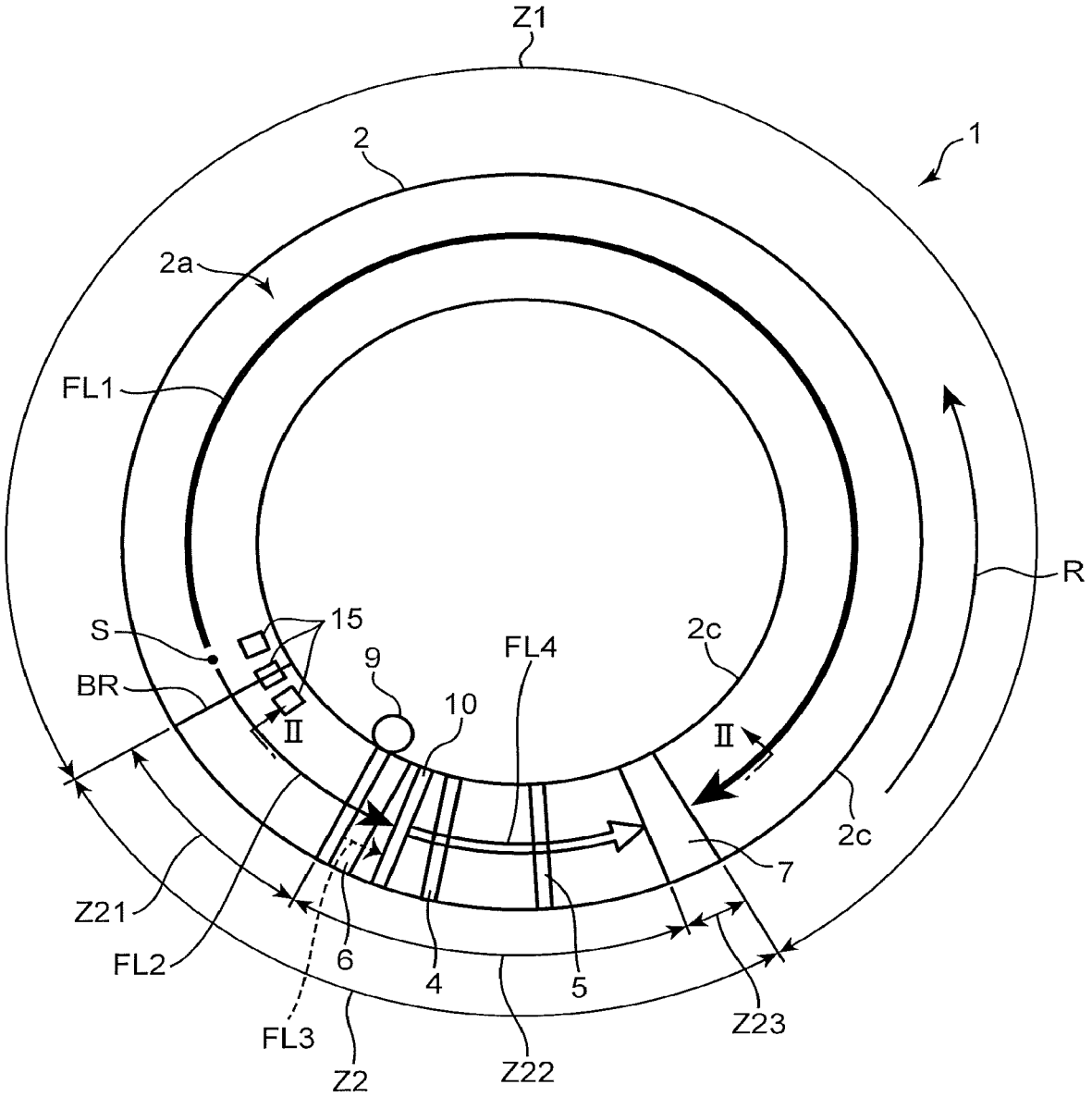
FIG. 1 is a plan view of a rotary hearth furnace according to an embodiment of the present invention.
Figure 2:
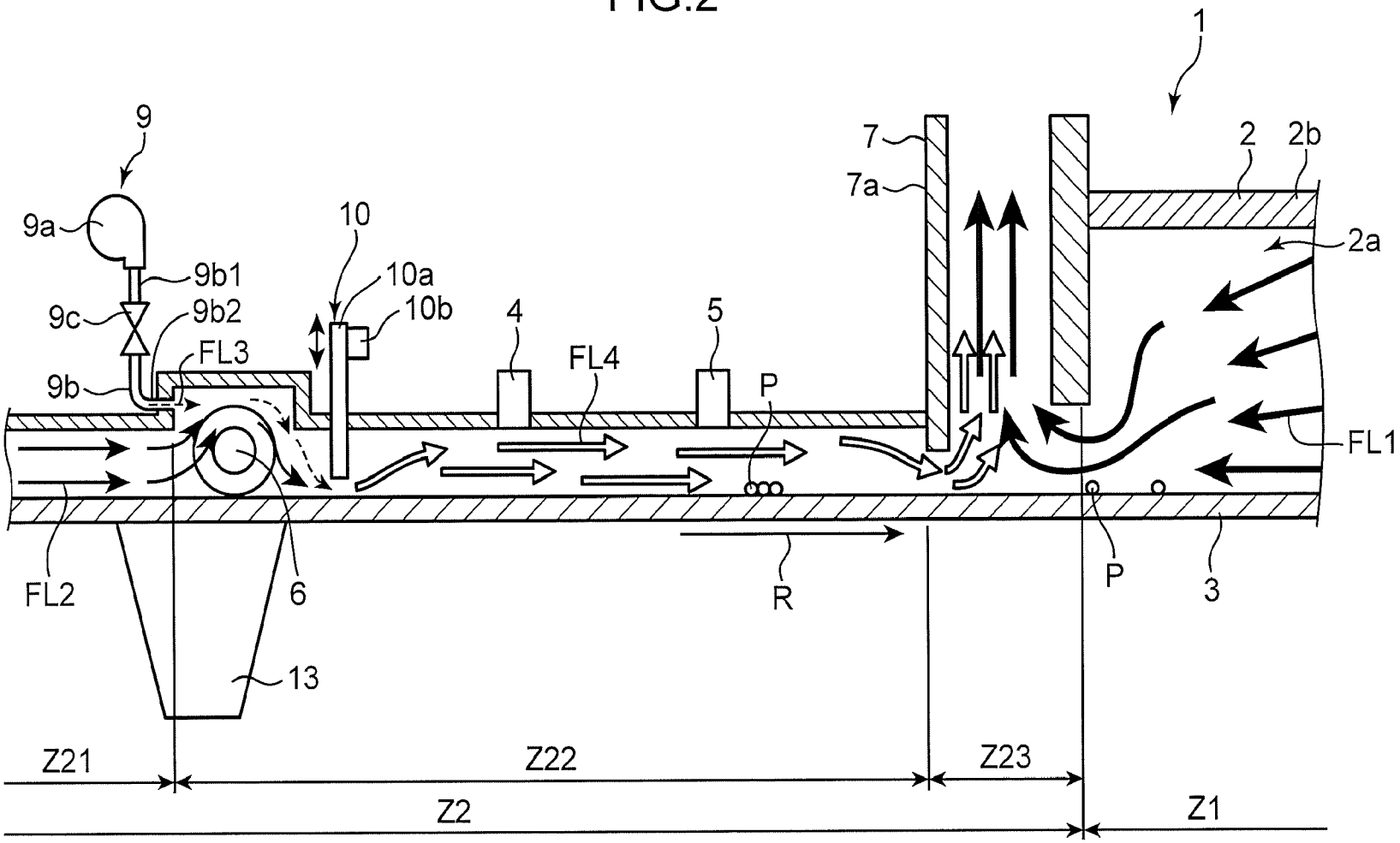
FIG. 2 is a view showing a cross section of the rotary hearth furnace taken along line II-II in FIG. 1.

FIG. 1 and FIG. 2 show a rotary hearth furnace 1 according to the embodiment. The rotary hearth furnace 1 includes: a ring-like furnace body 2; a ring-like hearth portion 3; a hearth covering charcoal supply portion 4; agglomerates supply portion 5; a discharge portion 6 through which produced reduced iron or the like is discharged to the outside of the furnace; and a gas exhaust portion 7 through which an exhaust gas generated in the furnace body 2 is discharged to the outside of the furnace. In the rotary hearth furnace 1, the hearth portion 3 is rotatably moved in the inside of the furnace body 2, and agglomerates P containing iron oxide placed on the hearth portion 3 are heated in the inside of the furnace body 2. With such an operation, iron oxide is reduced so that reduced iron is produced.

The furnace body 2 and the hearth portion 3 are formed of, for example, water-cooled support fixtures and refractories such as alumina applied to surfaces of the water-cooled support fixtures.

The furnace body 2 is formed in a shape so as to surround side portions and an upper portion of the ring-like space 2*a* having a ring-like continuous shape. For example, the furnace body 2 includes: a pair of peripheral walls 2*c* disposed concentrically and facing each other in a radial direction; and a ceiling plate 2*b* which connects upper ends of the pair of peripheral walls 2*c*. The pair of peripheral walls 2*c*, 2*c* and the ceiling plate 2*b* define the ring-like space 2*a* together with the hearth portion 3.

The hearth portion 3 forms a bottom portion of the ring-like space 2*a*, and is configured to be rotatable in a predetermined rotational direction R. Specifically, the hearth portion 3 forms a circular ring-like shape concentric with the pair of peripheral walls 2*c*, and has a fixed width along the radial direction. The hearth portion 3 defines a bottom of the ring-like space 2*a*, and is rotatable about a vertical axis in the rotational direction R (a counterclockwise direction in FIG. 1). The rotary hearth furnace 1 further includes a drive device not shown in the drawing. The drive device rotates the hearth portion 3 in the rotational direction R by applying a drive force to the hearth portion 3. The rotary hearth furnace 1 has the seal structure which suppresses the intrusion of outside air or the like into the ring-like space 2*a*. Specifically, the seal structure basically shields the ring-like space 2*a* formed by the furnace body 2 and the hearth portion 3 from outside.

The ring-like space 2*a* has a heating zone Z1 and a non-heating zone Z2. In the heating zone Z1, agglomerates P placed on the hearth portion 3 are heated. In the non-heating zone Z2, the agglomerates P are not heated. The heating zone Z1 and the non-heating zone Z2 is joined with each other in a ring-like shape to thereby form the ring-like space 2*a*.

The rotary hearth furnace 1 further includes a plurality of heating burners not shown in the drawing. The plurality of heating burners are arranged at intervals in a circumferential direction of the heating zone Z1 in the heating zone Z1. The plurality of heating burners heat agglomerates P and a gas which pass through the inside of the heating zone Z1 at a high temperature (approximately 1200 to 1500° C.) by burning a natural gas or the like. Accordingly, iron oxide contained in the agglomerates P is reduced so that reduced iron (specifically, granular molten metallic iron) is produced. To set a region of the heating zone Z1 on a downstream side in the rotational direction R at a high temperature, a temperature in the zone Z1 is adjusted by the burning adjustment of the heating burners or the like.

The non-heating zone Z2 has: in the rotational direction R, a cooling section Z21 disposed adjacently to an end of the heating zone Z1 on a downstream side; a machine chamber Z22 positioned downstream of the cooling section Z21; and a gas exhaust section Z23 positioned downstream of the machine chamber Z22 and upstream of the heating zone Z1.

In the cooling section Z21, a cooling device (not shown in the drawing) for cooling reduced iron and slag on the hearth portion 3 is disposed. Reduced iron and slag which is a secondary product of the reduced iron produced in the heating zone Z1 are solidified by cooling as the reduced iron and the slag pass through the cooling section Z21. In the cooling section Z21, a peeping window or the like which enables an operator to visually recognize a state of the inside of the ring-like space 2*a* from the outside is formed on the peripheral wall 2*c* of the furnace body 2, for example.

In the machine chamber Z22, the hearth covering charcoal supply portion 4, the agglomerates supply portion 5, and the discharge portion 6 described above are disposed as a mechanism for supplying agglomerates P and hearth covering charcoal placed on the hearth portion 3 into the inside of the furnace and a mechanism for discharging produced reduced iron or the like to the outside of the furnace.

The hearth covering charcoal supply portion 4 supplies the hearth covering charcoal to an upper surface of the hearth portion 3. The hearth covering charcoal is a fine granular coal material placed on the upper surface of the hearth portion 3 for avoiding the agglomerates P from contacting with the hearth portion 3. By interposing the hearth covering charcoal between the agglomerates P and the hearth portion 3, it is possible to prevent reduced iron and slag which is a secondary product of the reduced iron formed at the time of producing reduced iron from adhering to the hearth portion 3.

The agglomerates supply portion 5 is disposed downstream of the hearth covering charcoal supply portion 4 in the rotational direction R. The agglomerates supply portion 5 supplies agglomerates P containing iron oxide to the upper surface of the hearth portion 3 (specifically, on hearth covering charcoal placed on the upper surface of the hearth portion 3). The agglomerates P are approximately spherical solid substances containing carbonaceous reducing agent and iron oxide.

The discharge portion 6 is disposed downstream of the agglomerates supply portion 5 in the rotational direction R, specifically, downstream of the heating zone Z1 and the cooling section Z21 (in the vicinity of an upstream side end portion of the machine chamber Z22 in FIG. 1 and FIG. 2) in the rotational direction R. The discharge portion 6 is configured to take out reduced iron and slag generated by reduction of iron oxide contained in the agglomerates P in the heating zone Z1 to the outside of the furnace body 2. For example, the discharge portion 6 may have a rotation shaft extending in the horizontal direction, and a helical screw portion which integrally rotates with the rotation shaft. By rotating the screw portion together with the rotation shaft, it is possible to scrape off reduced iron in the horizontal direction and to discharge reduced iron to the outside of the furnace body through the reduced iron discharge chute 13.

The above-mentioned gas exhaust portion 7 is disposed in the gas exhaust section Z23. The gas exhaust portion 7 is configured to discharge an exhaust gas generated in the ring-like space 2*a* to the outside of the furnace body 2. The gas exhaust portion 7 includes, for example, a chimney 7*a* extending in a vertical direction penetrating a ceiling portion of the furnace body 2, and a gas exhaust fan (not shown in the drawing) which sucks a gas in the chimney 7*a*. The gas exhaust fan generates a negative pressure which sucks out an exhaust gas in the ring-like space 2*a* to the outside of the furnace.

An exhaust gas generated in the ring-like space 2*a* is divided into two gas flows FL1, FL2 respectively having directions opposite to each other. However, eventually, two gas flows FL1, FL2 are collected to the gas exhaust portion 7, and two gas flows FL1, FL2 are discharged from the gas exhaust portion 7 to the outside of the furnace body 2. Such two gas flows are formed of: the reverse direction gas flow FL1 in the direction opposite to the rotational direction R; and the forward direction gas flow FL2 in the same direction as the rotational direction R.

The rotary hearth furnace 1 according to this embodiment further includes: an introducing portion 9 through which a pressure regulating gas is introduced into the non-heating zone Z2 for controlling the above-mentioned gas flows FL1, FL2 of an exhaust gas generated in the ring-like space 2*a*; and a flow rate regulating portion 10 for regulating a flow rate of a gas which flows through the non-heating zone Z2.

The introducing portion 9 is disposed upstream of the gas exhaust portion 7 (on a left side of the gas exhaust portion 7 in FIG. 1 and FIG. 2) in the rotational direction R in the machine chamber Z22 of the non-heating zone Z2. The introducing portion 9 introduces a pressure regulating gas which is a gas for regulating a pressure in the ring-like space 2*a* into the machine chamber Z22. Specifically, this pressure regulating gas is introduced into the machine chamber Z22 so as to establish a pressure balance in the ring-like space 2*a* by adjusting a pressure loss in the non-heating zone Z2.

Specifically, the introducing portion 9 includes a blower 9*a*, an introducing pipe 9*b*, and a regulating valve 9*c*.

The introducing pipe 9*b* has an inlet side end portion 9*b*1 and an outlet side end portion 9*b*2. The inlet side end portion 9*b*1 communicates with a gas discharge port of the blower 9*a*. The outlet side end portion 9*b*2 communicates with an end portion of the machine chamber Z22 on an upstream side in the rotational direction R.

The blower 9*a* supplies air outside the furnace body 2 into the machine chamber Z22 through the introducing pipe 9*b* as the pressure regulating gas. The blower 9*a* is a forced draft fan. For example, the blower 9*a* is formed of a centrifugal fan or the like. Since the introducing portion 9 includes the blower 9*a*, air outside the furnace body 2 can be used as the pressure regulating gas in an inexpensive manner. However, the pressure regulating gas may be a gas other than air (for example, nitrogen, carbon dioxide or the like).

The regulating valve 9*c* is mounted on a middle portion of the introducing pipe 9*b*, and regulates an introducing amount of the pressure regulating gas (for example, air) to be introduced into the non-heating zone Z2. Alternatively, the regulating valve 9*c* may be disposed on a suction side of the blower 9*a*.

The introducing amount regulating portion according to the present invention is not limited to the regulating valve 9*c*. For example, the blower 9*a* may include an air supply amount variable unit such as an inverter motor as the introducing amount regulating portion in place of the regulating valve 9*c*. That is, the blower per se may have a function of regulating an introducing amount.

The outlet side end portion 9*b*2 of the introducing pipe 9*b* communicates with the end portion of the machine chamber Z22 on an upstream side in the rotational direction R as described above. Accordingly, it is possible to introduce air to an upstream side of the hearth covering charcoal supply portion 4 in the rotational direction R. FIG. 1 and FIG. 2 show an introduced air flow FL3 which flows in the same direction as the rotational direction R. The introduced air flow FL3 can prevent hearth covering charcoal supplied from the hearth covering charcoal supply portion 4 to the hearth portion 3 from being scattered by air.

With the arrangement of the outlet side end portion 9*b*2, the introducing portion 9 can introduce air from the blower 9*a* into a downstream side of the cooling section Z21 in the non-heating zone Z2 in the rotational direction R. By introducing air in such a manner, it is possible to prevent a phenomenon that reduced iron in the cooling section Z21 is oxidized by air again. Further, the air is not introduced into the cooling section Z21 and hence, there is no possibility that hearth covering charcoal existing on the upper surface of the hearth portion 3 is blown off before hearth covering charcoal is discharged from the discharge portion 6. Accordingly, it is possible to suppress lowering of visibility of the inside of the cooling section Z21.

The introduction and the flow rate regulation of the pressure regulating gas can be performed using only the regulating valve 9*c*, using only the blower 9*a* (forced draft fan) or using the combination of the regulating valve 9*c* and the blower 9*a*. To take into account a balance of an air supply pressure, it is preferable to use at least the blower 9*a*. However, when a gas per se which has already a sufficient pressure such as pressurized air is used, the introduction and the flow rate regulation of the pressure regulating gas can be performed using only the regulating valve 9*c*.

The flow rate regulating portion 10 is disposed between the introducing portion 9 and the gas exhaust portion 7 in the rotational direction R. The flow rate regulating portion 10 regulates a flow rate of the gas flow between the introducing portion 9 and the gas exhaust portion 7 in the non-heating zone Z2, that is, the flow rate of the gas flow FL4 which is formed by merging the forward direction gas flow FL2 of an exhaust gas and the introduced air flow FL3 by adjusting an opening area of the non-heating zone Z2. Accordingly, the flow rate regulating portion 10 can generate a pressure difference between the introducing portion 9 and the gas exhaust portion 7. That is, the flow rate regulating portion 10 can apply a pressure loss to the gas flow FL4.

In this embodiment, "opening area" of the non-heating zone Z2 is, for example, an area of an opening in a cross section of a flow passage of the gas flow FL4 in the non-heating zone Z2.

Specifically, the flow rate regulating portion 10 includes a liftable partition wall 10*a* and a drive unit 10*b* which lifts or lowers the partition wall 10*a*. The partition wall 10*a* is formed of water-cooled support fixtures and refractories such as alumina applied to surfaces of the water-cooled support fixtures, for example, in the same manner as the furnace body 2. The partition wall 10*a* is disposed in the inside of the ring-like space 2*a*. The partition wall 10*a* has a lower end portion which faces the hearth portion 3 in the vertical direction and is capable of approaching to or being away from the hearth portion 3 in the vertical direction. The partition wall 10*a* is lifted or lowered so as to adjust the opening area which is an area of a gap formed between the lower end portion and the hearth portion 3.

The partition wall 10*a* according to this embodiment is disposed upstream of the hearth covering charcoal supply portion 4 in the rotational direction R. With such arrangement, even when velocity of the gas flow FL4 is increased, since the gas flow FL4 between the introducing portion 9 and the gas exhaust portion 7 is throttled by the partition wall 10*a*, it is possible to prevent the gas from blowing off hearth covering charcoal placed on the upper surface of the hearth portion 3 by the hearth covering charcoal supply portion 4.

The partition wall 10*a* according to this embodiment is disposed downstream of the discharge portion 6 in the rotational direction R. With such arrangement, even when a flow speed of the gas is increased by throttling a flow rate of the gas flow FL4 by the partition wall 10*a*, it is possible to prevent the gas flow FL4 from blowing off hearth covering charcoal existing on the upper surface of the hearth portion 3 before hearth covering charcoal is discharged from the discharge portion 6.

With the use of the rotary hearth furnace 1 having the above-mentioned configuration, reduced iron can be produced by the following production method, for example.

The production method includes:

(I) a heating operation of producing reduced iron by reducing iron oxide by heating agglomerates P which contain the iron oxide placed on the hearth portion 3 in the heating zone Z1 which forms a section being a portion of the ring-like space 2*a;*

(II) a gas discharging operation of discharging an exhaust gas generated in the ring-like space 2*a* to the outside of the ring-like space 2*a* in the non-heating zone Z2 connected to the heating zone Z1 in the ring-like space 2*a;*

(III) an introducing operation of introducing a pressure regulating gas to a position upstream of a position where the exhaust gas is discharged in the non-heating zone Z2 in the rotational direction R; and (IV) a flow rate regulating operation of regulating a flow rate of a gas which flows between a discharge position at which the exhaust gas is discharged in the non-heating zone Z2 and an introducing position at which a pressure regulating gas introduced in the non-heating zone Z2 by adjusting an opening area of the non-heating zone Z2.

In this producing method, the above-mentioned heating operation, gas discharging operation, and introducing operation are respectively performed in parallel. The flow rate regulating operation may be always performed in parallel to the above-mentioned three operations or may be performed intermittently. For example, the flow rate regulating operation may be performed intermittently only when a change in pressure loss is large due to a large change in an exhaust gas amount in the furnace at the time of starting the production of the reduced iron or at the time of shifting to rated production operation.

The above-mentioned heating operation is performed in accordance with the following steps specifically. Firstly, in the machine chamber Z22, hearth covering charcoal supply portion 4 supplies hearth covering charcoal onto the hearth portion 3 rotating in the rotational direction R. Then, the agglomerates supply portion 5 supplies agglomerates P on the hearth covering charcoal. The agglomerates P placed on the hearth portion 3 are moved in the heating zone Z1 in the rotational direction R along with the rotation of the hearth portion 3. Along with the movement of the agglomerates P in the heating zone Z1 in the rotational direction R in this manner, a temperature of the agglomerates P is increased so that iron oxide contained in the agglomerates P is reduced. Further, the agglomerates P advance in the rotary zone Z1, produced reduced iron is further heated so that the reduced iron is melted. In this manner, reduced iron is separated from slag and is coagulated and hence, granular molten metallic iron is produced. After the heating operation is finished, produced granular molten metallic iron and slag are cooled and solidified when granular molten metallic iron and slag pass through the cooling section Z21. After the cooling operation is finished, granular metallic iron, slag, and hearth covering charcoal are discharged to the outside of the furnace through the discharge portion 6.

In the gas discharging operation, the gas exhaust portion 7 disposed in the gas exhaust section Z23 in the non-heating zone Z2 sucks an exhaust gas generated in the ring-like space 2*a*. With respect to the exhaust gas sucked in this manner, the exhaust gas flows through the ring-like space 2*a* in a state where the exhaust gas is diverged to the gas flows FL1, FL2 directed in the directions opposite to each other, and is eventually collected to the gas exhaust portion 7. The collected exhaust gas is discharged from the gas exhaust portion 7 to the outside of the ring-like space 2*a*.

In the introducing operation, the blower 9*a* of the introducing portion 9 is operated. Accordingly, air, as a pressure regulating gas, is introduced to an upstream side of the gas exhaust portion 7 which discharges the exhaust gas in the non-heating zone Z2 in the rotational direction R (that is, the machine chamber Z22), and the introduced air flow FL3 is formed. The introduced air flow FL3 merges with the previously mentioned forward direction gas flow FL2 thus forming the gas flow FL4, and the gas flow FL4 is discharged from the gas exhaust portion 7 to the outside of the ring-like space 2*a*.

In this embodiment, in the introducing operation, an introducing amount of air to be introduced to the non-heating zone Z2 is regulated corresponding to a change in an amount of an exhaust gas by the regulating valve 9*c* of the introducing portion 9. Specifically, in the introducing operation, the regulating valve 9*c* regulates an introducing amount of air such that a pressure at a downstream end of the heating zone Z1 in the rotational direction R, that is, a pressure at a boundary BR between the heating zone Z1 and the non-heating zone Z2 becomes highest in the ring-like space 2*a*.

In the flow rate regulating operation, the opening area which is an area of a gap formed between the lower end portion of the partition wall 10*a* and the hearth portion 3 is adjusted by lifting or lowering the partition wall 10*a* of the flow rate regulating portion 10 in a section sandwiched between the position of the gas exhaust portion 7 and the position of the introducing portion 9 in the non-heating zone Z2. In this manner, a flow rate of the gas flow FL4 in the section sandwiched between the gas exhaust portion 7 and the introducing portion 9 can be regulated.

In the flow rate regulating operation according to this embodiment, a flow rate of the gas flow FL4 in the non-heating zone Z2 is regulated by lifting or lowering of the partition wall 10*a* such that a pressure at the downstream end of the heating zone Z1 in the rotational direction R, that is, the pressure at the boundary BR between the heating zone Z1 and the non-heating zone Z2 becomes the highest in the ring-like space 2*a*.

That is, in the producing method for this embodiment, with the combination of the introducing portion 9 and the flow rate regulating portion 10, it is possible to regulate a flow rate of the gas flow FL4 in the non-heating zone Z2 such that a pressure at the boundary BR between the heating zone Z1 and the non-heating zone Z2 which is the downstream end of the heating zone Z1 in the rotational direction R becomes the highest in the ring-like space 2*a*.

The rotary hearth furnace 1 according to this embodiment further includes at least one pressure detection portion 15. The pressure detection portion 15 is disposed in the inside of the ring-like space 2*a*, for example, and detects pressures at the boundary BR and positions in the vicinity of the boundary BR. The at least one pressure detection portion 15 is preferably disposed, for example, at three portions consisting of the boundary BR, one portion in front of the boundary BR in the circumferential direction, and one portion behind the boundary BR in the circumferential direction respectively. By arranging the pressure detection portions 15 in this manner, it is possible to regulate an introducing amount of air by the regulating valve 9*c* of the introducing portion 9 based on pressures detected by three pressure detection portions 15 after an opening area of the gap formed between the partition wall 10*a* and the hearth portion 3 is adjusted by lifting or lowering the partition wall 10*a* of the flow rate regulating portion 10. Such a configuration enables the accurate regulation of an air introducing amount where a diverging point S of the above-mentioned two gas flows FL1, FL2 is positioned at the boundary BR with respect to an exhaust gas. However, either one of the regulation of an air introducing amount by the introducing portion 9 or the flow rate regulation by the flow rate regulating portion 10 may be performed.

As described above, to adjust the diverging point S of two gas flows FL1, FL2 with high accuracy, it is desirable to arrange the pressure detection portions 15 at at least three portions. For example, it is preferable that the at least one pressure detection portion 15 include one pressure detection portion 15 arranged at the boundary BR (target position), one pressure detection portion 15 arranged upstream of the boundary BR, and one pressure detection portion 15 arranged downstream of the boundary BR. However, there may be the case where the pressure detection portion 15 is arranged only at two portions or less. Although adjustment accuracy in this case is inferior to adjustment accuracy in the case where the pressure detection portion 15 is arranged at three portions or more, it is possible to adjust the position of the diverging point S by confirming the gas flow direction through an observation window disposed in the cooling section Z21.

The partition wall 10*a* is made of refractories and hence, the partition wall 10*a* has a large weight. Accordingly, responsiveness of adjustment of an opening area by lifting or lowering the partition wall 10*a* is lower than responsiveness of regulation of an air introducing amount by the introducing portion 9. Accordingly, it is preferable to perform the positional adjustment of the diverging point S of a gas by taking into account such a point. For example, at the time of starting the production where a combustion amount of a heating burner in the heating zone Z1 is relatively low, it is expected that a pressure loss in the heating zone Z1 becomes small compared to a rated operation time. Accordingly, by preliminarily adjusting the opening area between the partition wall 10*a* and the hearth portion 3 to a narrow area, it is possible to adjust the position of the diverging point S of a gas at a desired position within a shorter time. During the production of reduced iron, it is preferable to finely regulate an introducing amount of air by the regulating valve 9*c* of the introducing portion 9 based on a change in a pressure detected by the at least one pressure detection portion 15. With such an operation, it is possible to cope with a change in an amount of an exhaust gas generated from the heating zone Z1 with high responsiveness.

As has been described above, in the rotary hearth furnace 1 and the method for producing reduced iron using the rotary hearth furnace 1 in this embodiment, in the flow rate regulating operation, a flow rate of the gas flow FL4 (that is, the gas flow formed by merging the forward direction gas flow FL2 of an exhaust gas and the introduced air flow FL3) in the non-heating zone Z2 is regulated by adjusting an opening area in the non-heating zone Z2 between the introducing portion 9 and the gas exhaust portion 7 by the flow rate regulating portion 10. Accordingly, it is possible to apply a pressure loss corresponding to a pressure difference between the introducing portion 9 and the gas exhaust portion 7 to the gas flow FL4. As a result, even when a pressure loss changes in the heating zone Z1 due to a large change in an exhaust gas amount in the heating zone Z1, it is possible to adjust a pressure loss in the non-heating zone Z2 by performing either one of or both of the flow rate regulating operation by the flow rate regulating portion 10 and the introducing operation by the introducing portion 9 so as to maintain a favorable pressure balance. For example, it is preferable that the adjustment of a pressure loss in the non-heating zone Z2 with respect to a large change in the heating zone Z1 be performed by the flow rate regulating operation, and the adjustment of a pressure loss in the non-heating zone Z2 with respect to a small change in the heating zone Z1 be performed by the introducing operation. Accordingly, it is possible to maintain a more favorable pressure balance between the heating zone Z1 and the non-heating zone Z2. Specifically, in a state where the opening area is adjusted to an appropriate area by the flow rate regulating portion 10, even when an introducing amount of air which is a pressure regulating gas from the introducing portion 9 is suppressed low, it is possible to acquire a sufficient pressure loss. As a result, the position of the diverging point S of the gas flows FL1, FL2 of the exhaust gas in two directions can be adjusted such that the position is disposed in the vicinity of the boundary between the heating zone Z1 and the non-heating zone Z2.

The rotary hearth furnace 1 of this embodiment includes the flow rate regulating portion 10 and hence, it is possible to apply a pressure loss to the gas flow FL4 in the non-heating zone Z2 within an extremely limited narrow area of the non-heating zone Z2. Accordingly, it is possible to effectively make use of a space in the non-heating zone Z2. If the rotary hearth furnace 1 of this embodiment includes no such a flow rate regulating portion 10, it is necessary to apply a pressure loss to the entire section ranging from the introducing portion 9 to the gas exhaust portion 7 only by introducing outside air by the introducing portion 9. In this case, it is necessary to introduce an extremely large amount of air. However, in the rotary hearth furnace 1 of this embodiment, it is possible to suppress a flow rate of introducing air by the introducing portion 9 by regulating the flow rate by the flow rate regulating portion 10.

In the rotary hearth furnace 1 and the method for producing reduced iron, the flow rate regulating portion 10 regulates a flow rate of a gas which flows through the non-heating zone Z2 such that a pressure at the boundary BR between the heating zone Z1 and the non-heating zone Z2 which is the downstream end of the heating zone Z1 in the rotational direction R becomes the highest in the ring-like space 2*a*. The flow rate regulating portion 10 regulates a flow rate of a gas which flows through the non-heating zone Z2 as described above and hence, it is possible to position the diverging point S of the gas flows FL1, FL2 in the ring-like space 2*a* at the boundary BR between the heating zone Z1 and the non-heating zone Z2 which is the downstream end of the heating zone Z1 in the rotational direction R. Accordingly, over the entire region of the heating zone Z1, it is possible to set the flow of an exhaust gas as a complete counterflow which flows opposite to the moving direction of agglomerates P (that is, the above-mentioned rotational direction R). As a result, reduced iron can be produced with high heat exchange efficiency.

It is preferable that the diverging point S be adjusted so as to be positioned on the boundary BR. It is because thermal efficiently of the whole furnace is lowered (fuel consumption is deteriorated) in the case where the diverging point S is displaced from the boundary BR to either one of the heating zone Z1 or the non-heating zone Z2. However, in an actual operation, it is difficult to accurately align the position of the diverging point S with the boundary BR and hence, it is preferable to perform an operation such that the diverging point S is disposed as close as possible to the boundary BR. Specifically, to ensure visibility of the non-heating zone Z2, it is preferable that the diverging point S be positioned slightly displaced from the boundary BR toward the heating zone Z1.

The introducing portion 9 in the rotary hearth furnace 1 of this embodiment has the regulating valve 9*c* for regulating an introducing amount of a pressure regulating gas to be introduced into the non-heating zone Z2. Accordingly, it is possible to accurately regulate an introducing amount of a pressure regulating gas to be introduced into the non-heating zone Z2 in the introducing operation. With such regulation of an introducing amount of the pressure regulating gas, the position of the diverging point S of the gas flows FL1, FL2 of an exhaust gas can be adjusted with high accuracy.

The flow rate regulating portion 10 of the rotary hearth furnace 1 of this embodiment adjusts the opening area which is an area of a gap formed between the lower end portion of the partition wall 10*a* and the hearth portion 3 by lifting or lowering the partition wall 10*a*. With such adjustment of the opening area, it is possible to easily regulate a flow rate of the gas flow FL4 which flows through the non-heating zone Z2. Further, the partition wall 10*a* can have the simple structure, for example, the structure which is formed of water-cooled support fixtures and refractories applied to surfaces of the water-cooled support fixtures. The partition wall 10*a* can possess high durability due to such a structure.

In the rotary hearth furnace 1 of this embodiment, the flow rate regulating portion 10 includes the liftable partition wall 10*a*. However, the present invention is not limited to such a flow rate regulating portion 10. The flow rate regulating portion according to the present invention may have, for example, a rotation shaft extending in the horizontal direction and a partition plate which rotates using the rotation shaft as the center of rotation, and may change an opening area of gaps formed above and below the partition plate by changing a rotational angle of the partition plate in place of the liftable partition wall.

As described above, it is possible to provide the rotary hearth furnace which can adjust the position of the diverging point of an exhaust gas in the vicinity of the boundary between the heating zone and the non-heating zone while suppressing an amount of gas taken into the furnace, and the method for producing reduced iron using the rotary hearth furnace.

There is provided a rotary hearth furnace for producing reduced iron by reducing iron oxide by heating agglomerates containing iron oxide, the rotary hearth furnace including: a furnace body which has a pair of peripheral walls and a ceiling plate that enclose a ring-like space having a continuous ring-like shape at lateral sides and an upper side of the ring-like space, respectively; a ring-like hearth portion which forms a bottom portion of the ring-like space and which is rotatable in a predetermined rotational direction; a gas exhaust portion for discharging an exhaust gas generated in the ring-like space to the outside of the furnace body; an introducing portion; and a flow rate regulating portion. The ring-like space has a heating zone where the agglomerates placed on the hearth portion are heated and a non-heating zone where the agglomerates are not heated. The heating zone and the non-heating zone is joined with each other in a ring-like shape to thereby form the ring-like space. The gas exhaust portion is disposed in the non-heating zone. The introducing portion is disposed upstream of the gas exhaust portion in the rotational direction, and introduces a pressure regulating gas for regulating a pressure in the ring-like space into the non-heating zone. The flow rate regulating portion is disposed between the introducing portion and the gas exhaust portion in the non-heating zone, and regulates a flow rate of a gas which flows through the non-heating zone by adjusting an opening area of the non-heating zone.

The flow rate regulating portion of the rotary hearth furnace regulates a flow rate of a gas which flows through the non-heating zone by adjusting the opening area of the non-heating zone between the introducing portion and the gas exhaust portion and hence, it is possible to apply a pressure loss to the gas corresponding to a pressure difference between the introducing portion and the gas exhaust portion. With such a configuration, even when a pressure loss in the heating zone changes due to a large change in an exhaust gas amount in the heating zone, the pressure loss in the non-heating zone can be adjusted to maintain a favorable pressure balance. That is, a favorable pressure balance can be maintained between the heating zone and the non-heating zone regardless of the change. With the appropriate adjustment of the opening area by the flow rate regulating portion, it is possible to apply a sufficient pressure loss to the gas while suppressing an introducing amount of a pressure regulating gas from the introducing portion to a low level. Accordingly, it is possible to adjust the position of the diverging point of an exhaust gas in the vicinity of the boundary between the heating zone and the non-heating zone.

It is preferable that the flow rate regulating portion be configured to regulate a flow rate of a gas which flows through the non-heating zone such that a pressure at a boundary between the heating zone and the non-heating zone, the boundary being a downstream end of the heating zone in the rotational direction, becomes the highest in the ring-like space. With such adjustment, it is possible to position a diverging point of a gas flow in the ring-like space at a boundary between the heating zone and the non-heating zone, the boundary being a downstream end of the heating zone in the rotational direction. Accordingly, over the entire region of the heating zone, it is possible to set the flow of the exhaust gas as a complete counterflow which flows opposite to the moving direction of agglomerates (that is, the above-mentioned rotational direction). As a result, reduced iron can be produced with high heat exchange efficiency.

It is preferable that the introducing portion include an introducing amount regulating portion which regulates an introducing amount of the pressure regulating gas introduced into the non-heating zone. The introducing amount regulating portion can adjust with high accuracy the position of a diverging point of the flow of an exhaust gas by regulating an introducing amount of a pressure regulating gas introduced into the non-heating zone.

It is preferable that the flow rate regulating portion include a liftable partition wall disposed in the inside of the ring-like space, the partition wall have a lower end portion which faces the hearth portion and is capable of approaching to or being away from the hearth portion, and the partition wall be configured to be lifted or lowered so as to adjust the opening area which is an area of a gap formed between the lower end portion and the hearth portion. By lifting or lowering the partition wall, it is possible to easily regulate a flow rate of a gas which flows through the non-heating zone.

It is preferable that the introducing portion include a blower which supplies air outside the furnace body to the non-heating zone as the pressure regulating gas. With such a configuration, air outside the furnace body can be used as a pressure regulating gas in an inexpensive manner.

It is preferable that the non-heating zone include a cooling section which is continuous with a downstream side end portion of the heating zone in the rotational direction and in which the agglomerates which pass through the heating zone are cooled, and the introducing portion be configured to introduce the air to the position downstream of the cooling section in the rotational direction in the non-heating zone. By introducing air to the position downstream of the cooling section in the rotational direction in the non-heating zone in this manner, it is possible to prevent a phenomenon that reduced iron produced in the heating zone is brought into contact with the air and is oxidized by air again in the cooling section.

It is preferable that the rotary hearth furnace further include a hearth covering charcoal supply portion which supplies hearth covering charcoal onto an upper surface of the hearth portion in the non-heating zone, wherein the introducing portion be configured to introduce the pressure regulating gas to a position upstream of the hearth covering charcoal supply portion in the rotational direction. By introducing the pressure regulating gas to the position, it is possible to prevent the pressure regulating gas from blowing off hearth covering charcoal placed on the upper surface of the hearth portion by the hearth covering charcoal supply portion.

It is preferable that the flow rate regulating portion be disposed upstream of the hearth covering charcoal supply portion in the rotational direction. With such arrangement, even when a flow speed of the gas is increased by throttling a flow rate of a gas between the introducing portion and the gas exhaust portion by the flow rate regulating portion, it is possible to effectively prevent the gas from blowing off hearth covering charcoal placed on the upper surface of the hearth portion by the hearth covering charcoal supply portion.

Further, there is provided a method for producing reduced iron by reducing iron oxide by heating agglomerates containing the iron oxide using a rotary hearth furnace which includes: a furnace body having a pair of peripheral walls and a ceiling plate that enclose a ring-like space having a continuous ring-like shape at lateral sides and an upper side of the ring-like space, respectively; and a ring-like hearth portion which forms a bottom portion of the ring-like space and is rotatable in a predetermined rotational direction. The method includes: a heating operation of producing reduced iron by reducing iron oxide contained in agglomerates by heating the agglomerates placed on the hearth portion in a heating zone which forms a section being a portion of the ring-like space; a gas discharging operation of discharging an exhaust gas generated in the ring-like space to the outside of the ring-like space in a non-heating zone connected to the heating zone in the ring-like space; an introducing operation of introducing a pressure regulating gas to a position upstream of a position where the exhaust gas is discharged in the non-heating zone in the rotational direction; and a flow rate regulating operation of regulating a flow rate of a gas which flows between a discharge position at which the exhaust gas is discharged in the non-heating zone and an introducing position at which the pressure regulating gas is introduced in the non-heating zone by adjusting an opening area of the non-heating zone.

In this producing method, even when an amount of an exhaust gas generated in the heating zone largely changes, by adjusting an opening area of the non-heating zone corresponding to such a change in the amount of an exhaust gas, a flow rate of a gas which flows between the discharge position at which the exhaust gas is discharged in the non-heating zone and the introducing position at which the pressure regulating gas is introduced in the non-heating zone is regulated. Accordingly, it is possible to apply a pressure loss of an appropriate magnitude corresponding to an amount of an exhaust gas to a gas which flows through the non-heating zone between the discharge position and the introducing position. As a result, even when a pressure loss in the heating zone changes due to a large change in an amount of an exhaust gas in the heating zone, it is possible to adjust a pressure loss in the non-heating zone by performing either one of or both of the flow rate regulating operation and the introducing operation so as to maintain a favorable pressure balance between the heating zone and the non-heating zone.

It is preferable that, in the flow rate regulating operation, a flow rate of a gas which flows through the non-heating zone be regulated such that a pressure at a boundary between the heating zone and the non-heating zone, the boundary being a downstream end of the heating zone in the rotational direction, becomes the highest in the ring-like space. With such regulation, over the entire region of the heating zone, it is possible to set the flow of an exhaust gas in the heating zone as a complete counterflow which flows opposite to the moving direction of agglomerates (that is, the above-mentioned rotational direction). As a result, reduced iron can be produced with high heat exchange efficiency.

It is preferable that, in the introducing operation, an introducing amount of the pressure regulating gas introduced into the non-heating zone be regulated corresponding to a change in an amount of the exhaust gas. With such regulation, the position of a diverging point of the flow of the exhaust gas can be adjusted with high accuracy.

The invention claimed is:

1. A rotary hearth furnace suitable for producing reduced iron by reducing iron oxide by heating agglomerates comprising iron oxide, the rotary hearth furnace comprising:

a furnace body comprising a pair of peripheral walls and a ceiling plate that enclose a ring-like space having a continuous ring-like shape at lateral sides and an upper side of the ring-like space, respectively;

a ring-like hearth portion which forms a bottom portion of the ring-like space and which is rotatable in a predetermined rotational direction;

a gas exhaust portion for discharging an exhaust gas generated in the ring-like space an outside of the furnace body;

an introducing portion; and a flow rate regulating portion, wherein the ring-like space having a heating zone where the agglomerates placed on the hearth portion are heated and a non-heating zone where the agglomerates are not heated, the heating zone and the non-heating zone being joined with each other in a ring-like shape thereby forming the ring-like space, wherein the gas exhaust portion is disposed in the non-heating zone, wherein the introducing portion is disposed upstream of the gas exhaust portion in the rotational direction and is configured to introduce a pressure regulating gas for regulating a pressure in the ring-like space into the non-heating zone, wherein the flow rate regulating portion is disposed between the introducing portion and the gas exhaust portion in the non-heating zone and is configured to regulate a flow rate of a gas which flows through the non-heating zone by adjusting an opening area of the non-heating zone, and wherein the flow rate regulating portion is configured to regulate a flow rate of a gas which flows through the non-heating zone such that a pressure at a boundary between the heating zone and the non-heating zone, the boundary being a downstream end of the heating zone in the rotational direction, becomes the highest in the ring-like space.

2. The furnace of claim 1, wherein the introducing portion includes an introducing amount regulating portion which regulates an introducing amount of the pressure regulating gas introduced into the non-heating zone.

3. The furnace of claim 1, wherein the flow rate regulating portion includes a liftable partition wall disposed in the inside of the ring-like space, wherein the partition wall has a lower end portion which faces the hearth portion and is capable of approaching to or being away from the hearth portion, and wherein the partition wall is configured to be lifted or lowered so as to adjust the opening area formed by a gap between the lower end portion and the hearth portion.

4. The furnace of claim 1, wherein the introducing portion includes a blower which supplies air outside the furnace body to the non-heating zone as the pressure regulating gas.

5. The furnace of claim 2, wherein the non-heating zone includes a cooling section which is continuous with a downstream side end portion of the heating zone in the rotational direction and in which the agglomerates which pass through the heating zone is cooled, and wherein the introducing portion is configured to introduce the air to a position downstream of the cooling section in the rotational direction in the non-heating zone.

6. The furnace of claim 1, further comprising:

a hearth covering charcoal supply portion configure to supply hearth covering charcoal onto an upper surface of the hearth portion in the non-heating zone, wherein the introducing portion is configured to introduce the pressure regulating gas to an upstream side of the hearth covering charcoal supply portion in the rotational direction.

7. The furnace of claim 6, wherein the flow rate regulating portion is disposed upstream of the hearth covering charcoal supply portion in the rotational direction.

8. A method for producing reduced iron, the method comprising:

heating agglomerates that comprise iron oxide and are placed on a ring-like hearth portion in a heating zone which forms a section being a portion of a ring-like space in the rotary hearth furnace of claim 1;

discharging an exhaust gas generated in the ring-like space to the outside of the ring-like space in a non-heating zone connected to the heating zone in the ring-like space;

introducing a pressure regulating gas to a position upstream of a position where the exhaust gas is discharged in the non-heating zone in the rotational direction; and regulating a flow rate of a gas which flows between a discharge position at which the exhaust gas is discharged in the non-heating zone and an introducing position at which the pressure regulating gas is introduced by adjusting an opening area of the non-heating zone.

9. The method of claim 8, wherein in the regulating, a flow rate of a gas which flows through the non-heating zone is regulated such that a pressure at a boundary between the heating zone and the non-heating zone, the boundary being a downstream end of the heating zone in the rotational direction, becomes the highest in the ring-like space.

10. The method of claim 8, wherein in the introducing, an introducing amount of the pressure regulating gas introduced into the non-heating zone is regulated corresponding to a change in an amount of the exhaust gas.

11. The furnace of claim 1, further comprising:

a discharge portion in the non-heating zone configured to take out reduced iron and slag generated in the heating zone to the outside of the furnace body, wherein the flow rate regulating portion is disposed downstream of the discharge portion in the rotational direction.

12. The furnace of claim 1, further comprising:

a pressure detection portion which is disposed in the inside of the ring-like space and detects pressures at the boundary and positions in the vicinity of the boundary.

13. The furnace of claim 1, wherein the flow rate regulating portion includes a liftable partition wall disposed in the inside of the ring-like space.

14. The furnace of claim 2, wherein the flow rate regulating portion includes a liftable partition wall disposed in the inside of the ring-like space.

15. The furnace of claim 2, wherein the introducing portion includes a blower which supplies air outside the furnace body to the non-heating zone as the pressure regulating gas.

16. The furnace of claim 3, wherein the introducing portion includes a blower which supplies air outside the furnace body to the non-heating zone as the pressure regulating gas.

17. The furnace of claim 11, wherein the introducing portion includes a blower which supplies air outside the furnace body to the non-heating zone as the pressure regulating gas.

18. The furnace of claim 12, wherein the introducing portion includes a blower which supplies air outside the furnace body to the non-heating zone as the pressure regulating gas.

19. The furnace of claim 13, wherein the introducing portion includes a blower which supplies air outside the furnace body to the non-heating zone as the pressure regulating gas.

* * * * *